US005785097A

United States Patent [19]

Garcia

[11] Patent Number: 5,785,097

[45] Date of Patent: Jul. 28, 1998

[54] APPARATUS AND METHOD FOR FORMING A FLAT-TOP CHAIN LINK MATERIAL IN A CHAIN LINK WEAVING MACHINE

[75] Inventor: Jose G. Garcia, La Puente, Calif.

[73] Assignee: BMCI, Inc., South El Monte, Calif.

[21] Appl. No.: 834,721

[22] Filed: Apr. 1, 1997

[51] Int. Cl.[6] ..... B21F 24/17

[52] U.S. Cl. ..... 140/92.7; 140/24

[58] Field of Search ..... 140/3 R, 9, 24, 140/92.7; 245/6, 10

[56] References Cited

U.S. PATENT DOCUMENTS

| | | | |
|---|---|---|---|
| 444,753 | 1/1891 | Kitselman . | |
| 1,811,511 | 6/1931 | Mafera | 140/24 |
| 1,885,361 | 11/1932 | Land | 245/6 |
| 2,447,155 | 8/1948 | Brickman . | |
| 3,512,760 | 5/1970 | Rohrbacher . | |
| 3,722,554 | 3/1973 | Vanderfaeillie | 140/24 |

FOREIGN PATENT DOCUMENTS

| | | | |
|---|---|---|---|
| 172374 | 9/1952 | Austria . | |
| 0041930 | 12/1981 | European Pat. Off. . | |
| 330487 | 6/1930 | United Kingdom | 140/9 |

*Primary Examiner*—Lowell A. Larson
*Attorney, Agent, or Firm*—James G. O'Neill

[57] ABSTRACT

Chain link material for use in fences and other various applications are formed with flattened end portions so as to improve the handling and safety characteristics thereof. The flattened end portions of the chain link fence are formed by trimming, bending and then securing together cut ends of the wire forming the chain link material. This trimming, bending and securing is preferably performed in end flattening assemblies held on either side of a chain link material weaving machine, which assemblies are moveable into and out of contact with the cut ends of the wires in the chain link material so as to trim, bend and then secure the bent ends together by twisting, welding or clipping the same together.

20 Claims, 3 Drawing Sheets

APPARATUS AND METHOD FOR FORMING A FLAT-TOP CHAIN LINK MATERIAL IN A CHAIN LINK WEAVING MACHINE

BACKGROUND OF THE INVENTION

1. Field of the Invention

This invention relates generally to chain link fabric, and more particularly, to an improved chain link fence and fabric used for mine lagging, erosion control and the like, having flattened top and/or bottom ends, as well as, apparatus for, and methods of, making the same.

2. Description of Related Art

Chain link fence, and weaving machines for making the same are well known in the art. Companies such as BMCI, Inc., dba as Bergandi Machinery Company of South El Monte, Calif. manufacture and sell chain link weaving machines, such as their 2MT-VS variable drive automatic machine. In this Bergandi Machine, two strands of wire from two large coils of wire are continuously fed onto a forming mechanism (weaving blade), so that two needles at a time are formed into a picket in an intercoiled manner and then woven by a trough weaving mechanism to form continuous links of chain link.

After being woven together, the just woven picket is cut off at the ends, and a wire fabric of open construction is formed having sharp, cut ends. The formed wire fabric is then indexed through the machine to a point along the top thereof where selvage is performed. This selvage normally is accomplished by turret knucklers which form knuckles by bending over the sharpened ends thereof, or other turret mechanisms to twist the ends and form sharp barbs thereon.

These barbed or knuckled ends formed on the chain link fabric are then utilized as the top and bottom ends of the fabric when the fence is mounted on poles, or the open wire fabric may be used in furniture, in land fill, mines, rock control, soil retention, or other areas.

Such chain link fabric having knuckled or barbed ends, may be rolled into compacted form, i.e., wherein the diamonds formed in the chain link fabric are collapsed into each other so as to form a tighter roll of material. However, the knuckled or barbed ends of such compacted rolls become tangled and/or may be pulled apart when the roll is unwound. Therefore, there exists the need in the art for a chain link fabric having flat top and/or bottom ends which do not have knuckles or barbs formed thereon.

Although there are known types of fence, such as gabion, which might have flattened tops or bottoms, this type of fence is more expensive and is of a lighter gauge than chain link fabric. Therefore, the known materials do not have the required strength for all uses, and do not fully unroll, causing wastage, and adding further to the cost.

Therefore, there exists a need in the art for a chain link fabric with flattened ends, as well as, for apparatus for, and methods of, forming the same. The ends of the wire used to make such chain link fabric are first cut, then bent, and then secured together to form both flat top and bottom portions on the chain link fabric.

SUMMARY OF THE INVENTION

It is therefore, a general object of the present invention to provide chain link material having flattened, tangle free top and/or bottom portions. It is a particular object of the present invention to provide an improved and simplified method for making chain link fabric with flattened ends. It is another particular object of the present invention to provide apparatus for trimming, bending and securing together cut ends of woven chain link fence to form flattened, tangle free ends thereon. It is a further particular object of the present invention to provide tangle-free, compactible chain link material that may be laid out on the ground and easily unrolled, without the need of plastic as currently required to keep from tangling. And, it is still a further object of the present invention to provide chain link material with flattened bottom and top ends for use around children and animals, providing added safety features.

These and other objects of the present invention are achieved by providing apparatus for trimming, bending and securing together the cut ends of the wire used in chain link material to form flattened ends thereon. The trimming, bending and securing of all the cut ends of the chain link material is performed at a single selvage station in a chain link fence weaving machine. The cut ends of the wire used in chain link material is indexed to the selvage station where it is first trimmed to desired length by means brought into contact with the cut ends. Each trimmed end is then bent into a parallel position adjacent to another bent end, and these parallel, bent ends are then secured together as by twisting, welding or by other securing means brought into contact therewith.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved, simplified apparatus and method to form flattened end chain link material and the resultant product thereof.

Figure 1:
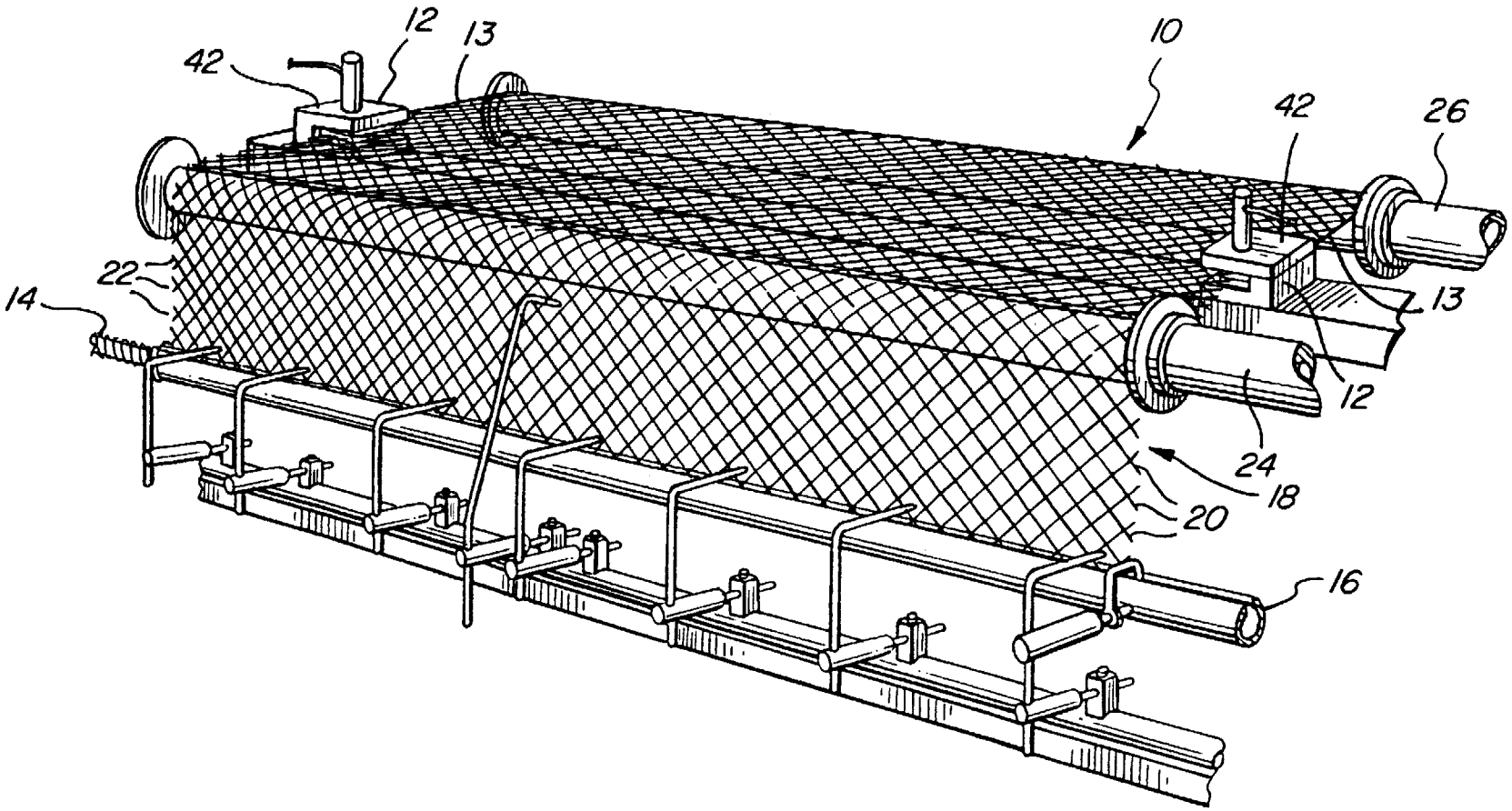
FIG. 1 is a perspective, schematic view showing a chain link fence weaving machine embodying the novel features of the present invention.

Referring now to FIG. 1 of the drawings, there shown is a schematic representation of a chain link fence weaving machine 10. This weaving machine is of the so-called flat top type and has incorporated therein, end flattening assemblies or means 12, two of which are shown located on opposite sides of the chain link material as it exits from the wire weaver. The chain link weaving machine itself may be of the automatic two-wire type wherein wire from large coils of wire (not shown) are continuously fed into a coiling mechanism 14 so that two wires at a time are intercoiled and then woven by a weaving mechanism 16 to form continuous links of chain link material 18. After weaving, the two wires just woven are cut by a cutting mechanism, not shown, so that opposite ends 20 and 22 of the wires in the chain link material provide sharpened ends. In the present invention, the cut, sharpened ends 20 and 22 are cut so that the cut ends are longer than those normally provided when weaving chain link material. The chain link material 18 is normally made from a galvanized steel, PVC, aluminum, or the like, of sufficient gauge to provide a strong material which is generally resistant to weather. As in known machines, the material 18 with the freshly cut ends 20 and 22, is indexed through the machine. That is, in the present invention the end flattening assemblies 12 trim, bend and secure together the bent ends to provide flattened tops and bottoms 13 to the woven chain link material for wider use and better safety purposes.

The woven chain link material 18 exits from the wire weaving mechanism 16 and is held in a stretched out position as it passes over rollers 24 and 26. The end flattening assemblies 12 are preferably located intermediate to rollers 24 and 26 and are connected to actuating means, such as pneumatic operators or the like (not shown), well known to those skilled in the art of operating turret knucklers or twisters. It should be noted that, in FIG. 1, the end flattening assemblies 12 are shown in the forward or operating position, and that they would move outwardly, away from the chain link material 18 when the chain link material is being indexed.

Figure 4:
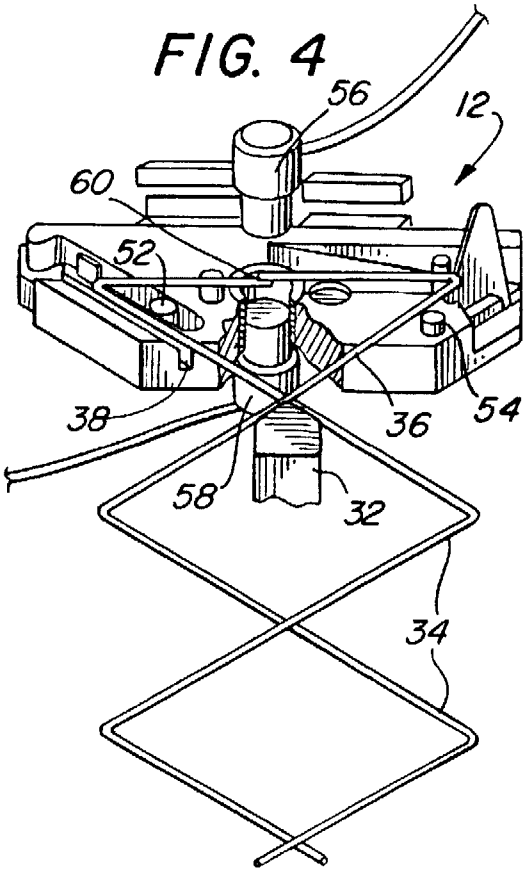
FIG. 4 is a schematic representation of one embodiment of a welding means for securing the parallel, bent ends of the wires in the chain link material together.
Figure 3:
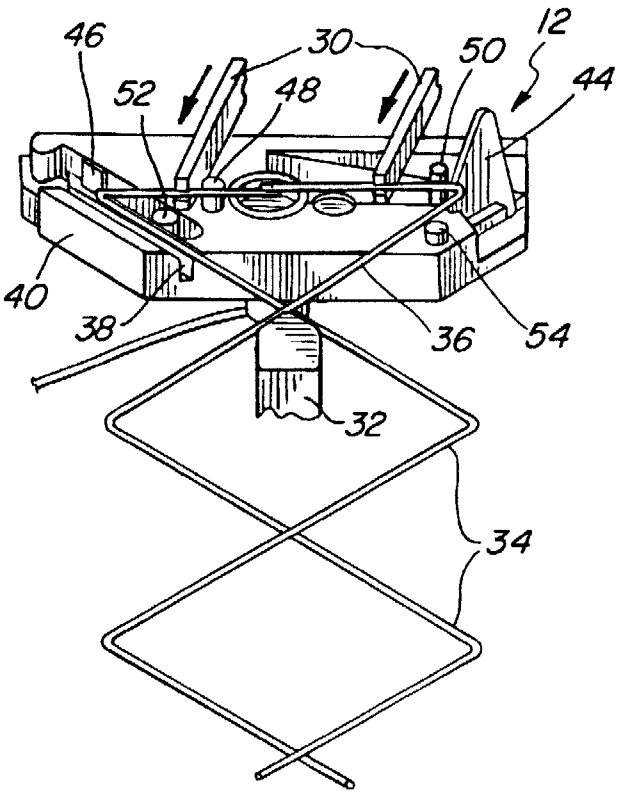
FIG. 3 is a schematic representation of the step of bending the trimmed ends of the wires into parallel positions where they may be secured together.
Figure 2:
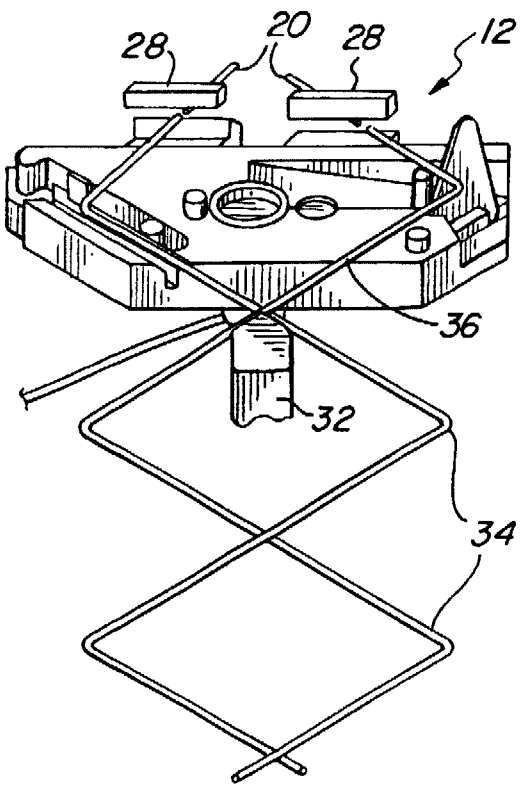
FIG. 2 is a schematic representation of the step of trimming the cut ends of the woven wire in the chain link material of the present invention.

Turning now to FIGS. 2 through 4, there shown are schematic representations of a method and apparatus for operation of the end flattening assemblies or means 12. It is to be understood that these assemblies are shown without top portions thereof for reasons of clarity. As is more clearly shown in FIG. 1, each of these end flattening assemblies 12 would have a top portion 42 which would closely match or mate with a lower portion 40 thereof. In operation, the chain link material 18 is formed by the coiling, weaving and cutting mechanisms, and the formation occurs in increments since each pair of wires are woven while the completed chain link material 18 remains stationary. Once each pair of wires is woven into the end of the chain link material and cut off, the completed chain link material 18 is moved incrementally over the guide rollers 24 and 26 by a take up unit (not shown), of a type well known to those skilled in the art, to position the chain link material to receive the next pair of wires for weaving. The flattening of the ends 20 and 22 of the wires in the chain link material is preformed as the chain link material is being woven. The take up unit is driven intermittently to provide for the desired incremental movement of the chain link material 18, and, therefore, the end flattening assemblies 12 may be operated in accordance with the intermittent movement of the take up unit.

Figure 5:
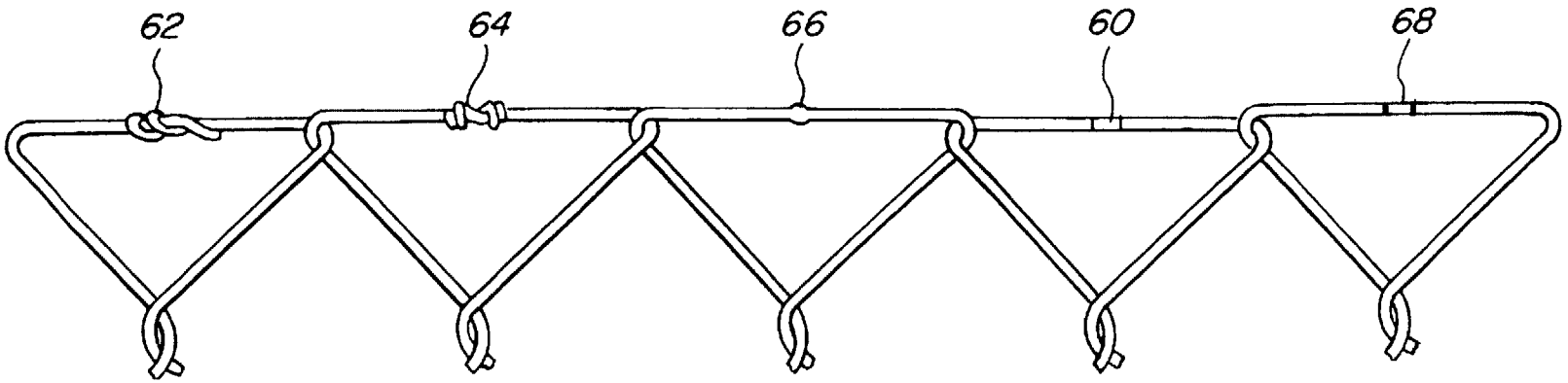
FIG. 5 illustrates a portion of chain link material showing various flat ends secured together by a single twist, a reverse twist, a butt weld, a lap weld and by a clip.

For example, each of the end flattening assemblies 12 may be actuated by operating means, such as a pneumatic actuator, to move the flattening assemblies 12 to the forward or operating position as shown in FIGS. 1 through 4, with the ends 20 and/or 22 of respective wires extend into and under trim blade means 28. The trim blade means 28 are then actuated so as to smoothly cut off the ends, such as the ends 20 shown, to the desired length. After trimming, the ends 20 are then bent inwardly so as to be parallel, thereby forming a flattened end portion. This bending is most clearly shown in FIG. 3, wherein a pair of arms or blades 30 are moved inwardly against the trimmed end portions 20, so as to bend these end portions parallel to each other, and preferably contacting. This bending is preferably accomplished as follows: an arm or finger 32 is brought into contact with an end of a diamond 34 while the portions of a half diamond 36 are secured in the end flattening assembly 12, as by means of mating slots or trough means 38, (one each in lower portion 40, shown in FIG. 3, and a matching slot formed in an upper portion of 42, shown in FIG. 1). In addition to the slot 38, the bending is aided by bending guides 44 and 46, held on either side of the lower portion 40 adjacent to the outer ends of the half diamond 36. After being bent to the parallel position to form parallel, flattened ends, shown in FIG. 3, the bent ends are held in position by means of pins 48 and 50, while other pins 52 and 54 hold the sides of the half diamond 36 in position. When held in the bent position shown in FIG. 3, with overlapping end 60, the parallel, flattened ends may then be secured together by any desired means, such as a securing means 56, 58. For example, welding elements 56 and 58 may be brought into contact and to weld the overlapping ends 60 into a lap type weld 60, as shown in FIGS. 4 and 5.

It is to be understood that other types of equivalent means may be used to trim the ends 20, 22, to bend the remaining portions of these ends into position, and to secure these ends in the parallel positions so as to form straight, flat ends. For example, as shown in FIG. 5, a flattened end having a single twist 62 may be formed thereon by turret means, similar to a barbing turret. A reverse twist 64 may be formed thereon by another type of barbing turret means. A butt weld 66 may be formed by exactly trimming the ends 20, 22, by trim means 28 so that the ends abut against each other, and then spot welding these ends together by welding means such as 56, 58. Or the overlapping trimmed end portions 20 may be held together by clip means 68. Such clip means may be applied over the parallel, overlapping portions by means well known to those skilled in the art, such as those for applying a band of metal around the ends and crimping the same in place.

Thus, there has been described an improved apparatus and methods for producing an improved product, namely, a chain link material having flatten ends, in place of the known knuckled or barbed ends, heretofore available. These flattened end portions are tangle free and will, therefore, not come apart during use. The flattened ends may take a number of different configurations, and are preferably formed by operation of end flattening means which first trim off an excess amount of sharpened end portions 20, 22, and then bends these trimmed ends so that they form parallel portions which may be readily secured together to form chain link material having flattened ends which are so desirable in a chain link material, but was previously unavailable because of the limitations in the known machines and methods. Such chain link material, in addition to the advantages discussed above, will also provide the unexpected advantage of holding in place, slats, sometime inserted in chain link fencing for privacy.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A chain link material having flattened ends formed in a chain link weaving machine by the following steps:

weaving a continuous sheet of chain link material in a weaving machine with opposed ends of said continuous sheet of chain link material having cut, sharpened ends;

indexing said continuous sheet of chain link material through said chain link weaving machine until at least one of the opposed ends having cut, sharpened ends is brought to an end flattening assembly mounted in said chain line weaving machine;

trimming the cut sharpened ends by trimming means held in said end flattening assembly;

bending said trimmed ends to parallel positions by bending means in said end flattening assembly whereby a pair of said trimmed ends contact each other in a flattened configuration; and securing the flattened, contacting, trimmed ends together by securing means held in said end flattening assembly to form a flattened edge on the chain link material.

2. The chain link material of claim 1 wherein both of said opposed ends of said chain link material are brought into end flattening assemblies.

3. The chain link material of claim 1 wherein said parallel contacting, flattened, trimmed ends are secured together by a butt weld formed by welding elements held in said end flattening assembly.

4. The chain link material of claim 1 wherein said parallel contacting, flattened, trimmed ends are secured together by a lap weld formed by welding elements held in said end flattening assembly.

5. A method of forming flattened end portions on a plurality of linked together chains in a chain link material formed in a chain link fence weaving machine, by end flattening means held in said chain link weaving machine, comprising the steps of:

trimming cut off end portions of said chain link material to a desired length in said end flattening means;

bending said trimmed end portions into parallel, contacting, flattened portions in said end flattening means; and, securing said parallel, contacting, flattened end portions together in said end flattening means to form at least one flattened end assembly on said chain link material.

6. The method of claim 5 wherein said parallel, contacting, flattened end portions are secured together by a butt weld formed by welding means held in said end flattening means.

7. The method of claim 5 wherein said parallel, contacting, flattened end portions are secured together by a lap weld formed by welding means held in said end flattening means.

8. An apparatus for forming flattened end portions on chain link material in a chain link fence weaving machine, wherein the improvement comprises:

means for mounting at least one end flattening means at a position adjacent, sharpened cut ends of chain link material after the forming of said chain link material on said chain link fence weaving machine;

said at least one end flattening means including;

trimming means for cutting off the sharpened, cut off end portions of said chain link material;

bending means for bending said trimmed cut ends into flattened, contacting end portions; and securing means for securing said flattened, contacting end portions together so as to form flattened end portions on said chain link material.

9. The apparatus of claim 8 wherein there are two end flattening means on opposed sides of said chain link material, and said securing means is a turret means movable into and away from said chain link material and forming said flattened, contacting end portions into a single twist.

10. The apparatus of claim 8 wherein there are two end flattening means on opposed sides of said chain link material, and said securing means is a turret means movable into and away from said chain link material and securing said flattened, contacting end portions together in a reverse twist.

11. The apparatus of claim 8 wherein there are two end flattening means on opposed sides of said chain link material, and said securing means is a pair of welding elements welding said flattened, contacting end portions together by a butt weld.

12. The apparatus of claim 8 wherein said securing means is a welding means comprising a pair of reciprocating welding elements which secure said flattened, contacting cut end portions together by means of a lap weld.

13. The apparatus of claim 8 wherein there are two end flattening means on opposed sides of said chain link material, and said securing means secures said flattened, contacting end portions together by a clip means.

14. The apparatus of claim 8 wherein said trimming means comprises a plurality of trim blades held in said end flattening means to form square cut ends, and said bending means comprises actuating means moving a plurality of arms into contact with said trimmed square cut end portions to bend said trimmed square cut end portions.

15. The apparatus of claim 14, further including bend guide means held in said end flattening means for holding and guiding said square cut ends while they are being bent, and further means for holding said bent flattened, contacting square cut end portions in position while they are being secured together.

16. The apparatus of claim 15 wherein there are two end flattening assemblies on opposed sides of said chain link material on said chain link weaving machine.

17. The apparatus of claim 15 wherein said further means for holding said flattened, contacting square cut end portions in position while being secured together, comprise pin means securely holding sides of a half diamond in position.

18. The apparatus of claim 17 wherein there are two end flattening assemblies mounted on said chain link weaving machine, on opposed sides of said chain link material.

19. The apparatus of claim 8 wherein said trimming means are trim blades which square cut said sharpened cut ends at 90°.

20. The apparatus of claim 19, further including an arm for holding an end of a diamond in said chain link material and wherein said end flattening assembly includes bend guide means having holding slots formed therein and mechanical bend guides holding sides of the square cut ends being bent.

* * * * *